US005209648A

United States Patent [19]

Ishizaki et al.

[11] Patent Number: 5,209,648

[45] Date of Patent: May 11, 1993

[54] ROTARY-VANE PUMP

[75] Inventors: Kazuyoshi Ishizaki; Masahiko Hara, both of Kanagawa, Japan

[73] Assignee: Atsugi Unisia Corporation, Kanagawa, Japan

[21] Appl. No.: 667,427

[22] Filed: Mar. 11, 1991

[30] Foreign Application Priority Data

Mar. 14, 1990 [JP] Japan ..... 2-63446

[51] Int. Cl.[5] ..... F04B 49/08

[52] U.S. Cl. ..... 417/310; 417/300

[58] Field of Search ..... 417/300, 310

[56] References Cited

U.S. PATENT DOCUMENTS

| | | | |
|---|---|---|---|
| 2,910,944 | 11/1959 | Pettibone | 417/300 |
| 3,384,020 | 5/1968 | Searle | 417/300 |
| 4,401,417 | 8/1983 | Davis | 417/300 |
| 4,505,649 | 3/1985 | Masuda et al. | 417/300 |
| 4,597,718 | 7/1986 | Nakano et al. | 417/300 |
| 4,708,598 | 11/1987 | Sugita et al. | 417/300 |
| 4,715,793 | 12/1987 | Johann et al. | 417/300 |
| 4,770,612 | 9/1988 | Teubler | 417/300 |

FOREIGN PATENT DOCUMENTS 1459161 1/1975 United Kingdom .

*Primary Examiner*—Richard A. Bertson
*Assistant Examiner*—Alfred Basichas
*Attorney, Agent, or Firm*—Bachman & LaPointe

[57] ABSTRACT

A rotary-vane pump has a pump outlet, a pressure chamber of the pump, a flow control valve, and a throttle disposed between the pump outlet and the flow control valve. According to the present invention, the throttle is formed by an insert which is disposed in a pressure passage between the pump outlet and the flow control valve. Specifically, the pressure passage is disposed between the pump outlet and the pressure chamber, and the insert is hollow cylindrical and has an axial bore having one axial end portion disposed on the pressure passage. The insert is disposed in the pressure passage at an angle approximately 90° in relation to the inflow direction of pressure medium in the passage.

2 Claims, 1 Drawing Sheet

ROTARY-VANE PUMP

BACKGROUND OF THE INVENTION

The present invention relates to a rotary-vane pump, particularly for servo steering systems in motor vehicles, which contains a flow control valve and a throttling means.

The function of such pumps is to provide a delivery flow which is as constant as possible despite varying driving speeds of the pump.

A pump of this kind is disclosed in U.S. patent application Ser. No. 07/572,894 filed on Aug. 24, 1990, now U.S. Pat. No. 5,098,259. The difference in the pressure upstream and downstream of a throttling bore is used to operate the flow control valve. With increasing vehicle speed, and consequently with increasing rotational speed of the pump, the flow control valve is opened further, so that a larger proportion of the delivery is passed to the drain side of the pump and the useful flow remains constant.

In power assisted steering systems for high speed vehicles there is an increasing demand that with rising speed of travel the steering reaction should increase. This kind of reaction is intended to give the driver of the vehicle a reliable road feel even at high speeds. However, the increased delivery power of the pump at higher rotational speeds increases the hydraulic steering assistance, and the proportion of mechanical power to be supplied by the driver is reduced.

Another pump is known from GB Patent No. 1,459,161. In this known pump, a throttling means is constituted by a discharge and throttle port in a cylindrical insert which is angularly adjustably disposed in a pressure passage transversely to the axis thereof between a pressure chamber of the pump and a flow control valve.

The invention aims at providing a rotary-vane pump whose delivery flow characteristic is suitable for application to the power steering system.

SUMMARY OF THE INVENTION

Accordinaly, the present invention provides a rotary-vane pump, having a pump outlet, a pressure chamber of the pump, a flow control valve, and a throttling means disposed between the pump outlet and the flow control valve, wherein the throttling means is constituted by a discharge and throttle port in an insert which is disposed in a pressure passage between the pump outlet and the flow control valve.

Specifically, the pressure passage is disposed between the pump outlet and the pressure chamber, and the insert is hollow cylindrical and has an axial bore having one axial end portion serving as the discharge and throttle port.

DETAILED DESCRIPTION OF THE INVENTION

Figure 1:
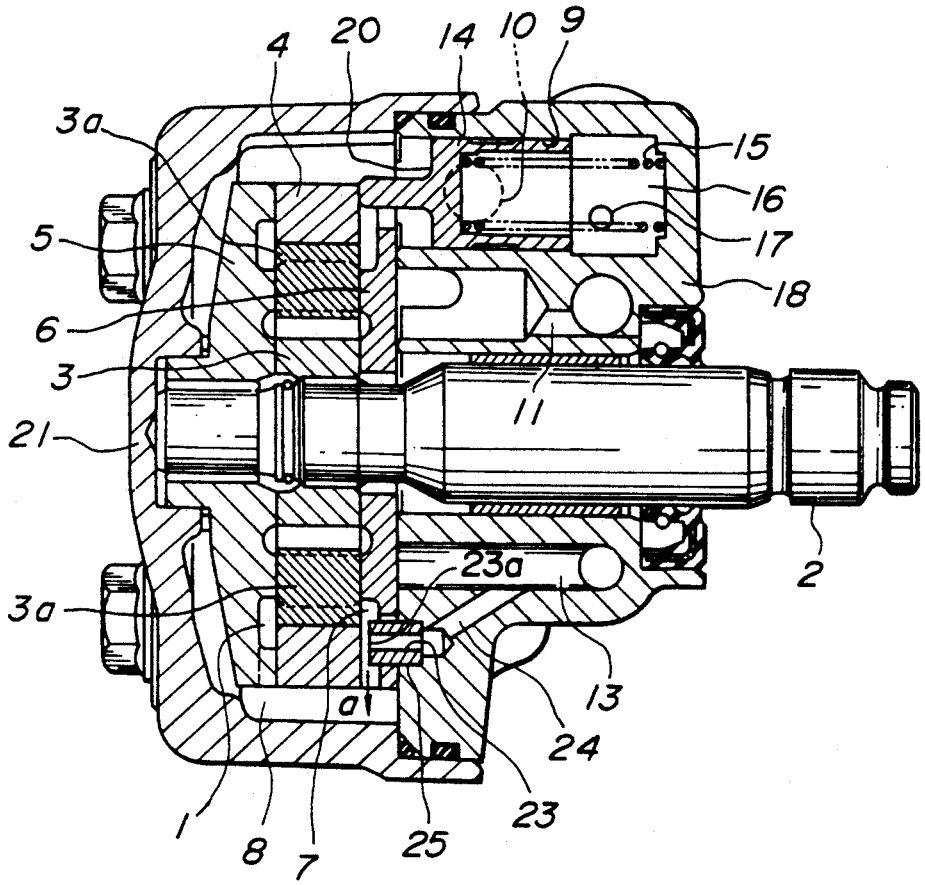
FIG. 1 is a longitudinal section through a rotary-vane pump according to the present invention.

Referring to the drawing, a casing 18, which is closed by a cover 21, contains a cam ring 4 disposed between two end plates 5 and 6. The cam ring 4 is secured to the end plates 5 and 6 against rotation. A radially slotted, cylindrical rotor 3 connected to a driving shaft 2 is arranged in the cam ring 4. Vanes 3*a* are guided in the slots of the rotor 3 so as to be radially movable. Between the outer periphery of the cam ring 4 and the cover 21 there is formed in the cover 21 a pressure chamber 8 which is in communication with a pressure passage 7 in the end plate 6. The pressure passage 7 allows pressure medium from a pump outlet port 1 in the end plate 5 to flow into the pressure chamber 8. Depending on the rotational speed of the pump, a flow control valve 20 allows pressure medium from the pressure chamber 8 to flow into a drain passage 10. The flow control valve 20 has a pressure responsive spool 14 received in a spool bore 9 in the casing 18. The bore 9 has one end directly opening to the pressure chamber 8 and the opposite end closed. The spool is biased by a spring 15 disposed in a back-up chamber 16 defined in the bore 9 between the spool 14 and the closed end of the bore 9.

Between the pump outlet 1 and the pressure chamber 8 there is provided in the pressure passage 7 a hollow cylindrical throttling insert 25 having a discharge and throttle port 23*a*. The insert 25 fitted through the end plate 6 to the casing 18 has an axial bore 23 having one end serving as the discharge and throttle port 23*a*. The insert 25 is disposed in the pressure passage 7 transversely to the inflow direction of the pressure medium (as indicated by an arrow a). By means of the insert 25 the cross-sectional area of the pressure passage 7 is locally reduced in size. Through the port 23*a*, the axial bore 23, and a passage, pressure medium is delivered to a consumer, which for example is constituted by a power steering system. A pressure is transmitted in a known manner from the passage 13 to a port 17 opening to the back-up chamber 16 of the flow control valve 20.

The insert 25 may be disposed either in the middle or away from the middle of the pressure passage. By this means the flow cross-sectional area in the pressure passage 7 is reduced to a greater or lesser extent.

Since the size of the cross-sectional area of the pressure passage 7 is reduced in the zone of the throttle insert, static pressure occuring in this zone decreases with rising rotational speed. The pressure medium discharged under static pressure decreasing with rising rotational speed. The pressure at the back-up chamber 16 of the flow control valve 20 decreases with rising rotational speed. The tendency of the flow control valve 20 to open increases with rising rotational speed. Thus, the delivery flow decreases with increasing rotational speed of the pump.

In this embodiment, the throttle port 23*a* is disposed in the pressure passage 7 at an angle 90° in relation to the inflow direction of the pressure medium (arrow a). In this position of the throttle insert 25, the delivery flow decreases strongly with increasing rotational speed of the pump. Thus, a delivery flow having a decreasing delivery tendency with rising rotational speed is achieved.

What is claimed is:

1. A rotary-vane pump, comprising:

a casing with two end plates in spaced relationship;

a cover connected to and closing said cover;

a cam ring disposed between said two end plates and secured thereto against rotation;

a driving shaft;

a cylindrical rotor connected to said driving shaft and arranged in said cam ring, said cylindrical rotor having a plurality of vanes guided in radially slots thereof and radially movable;

said cam ring having an outer periphery which cooperates with said cover to define between said outer periphery of said cam ring and said cover a pressure chamber;

one of said two end plates having a pump outlet port and a pressure passage having one end communicating with said pump outlet port and an opposite end communicating with said pressure chamber;

said casing having a spool bore with one end directly opening to said pressure chamber and an opposite end closed;

a pressure responsive spool received in said spool bore, said pressure responsive spool defining a back-up chamber within said spool bore between said pressure responsive spool and said closed opposite end of said spool bore;

a hollow cylindrical throttling insert fitted to said casing through said one of said two end plates and having an axial bore which has one end opening directly to said pressure passage and an opposite end; and means for establishing flow communication between said opposite end of said hollow cylindrical insert and said back-up chamber.

2. A rotary-vane pump as claimed in claim 1, wherein said insert is constructed and arranged as to define, within said pressure passage, a zone where the cross sectional area of said pressure passage is reduced.

* * * * *